United States Patent [19]

Infanti

[11] Patent Number: 4,876,969

[45] Date of Patent: Oct. 31, 1989

[54] ROLLING DISPLAY TABLE FOR ICE SCULPTURES AND THE LIKE

[75] Inventor: Vittorio Infanti, Staten Island, N.Y.

[73] Assignee: Infanti Chair Manufacturing Corp., Staten Island, N.Y.

[21] Appl. No.: 193,908

[22] Filed: May 13, 1988

[51] Int. Cl.[4] ..... A47B 85/00

[52] U.S. Cl. ..... 108/24; 108/23

[58] Field of Search ..... 108/24, 23, 25, 26, 108/50; 312/281, 290, 272, 306

[56] References Cited

U.S. PATENT DOCUMENTS

| | | | |
|---|---|---|---|
| 1,952,508 | 3/1934 | Schapp et al. . | |
| 2,022,591 | 11/1935 | Everitt | 108/24 X |
| 2,114,460 | 4/1938 | Ziegler | 108/23 X |
| 2,218,395 | 10/1940 | Hallbauer | 108/23 |
| 2,859,082 | 11/1958 | Logue | 108/25 X |
| 2,888,205 | 5/1959 | Trucco . | |
| 3,635,174 | 1/1972 | Ball et al. | 108/23 X |
| 3,745,303 | 7/1973 | Epperson et al. | 108/25 X |
| 3,807,356 | 4/1974 | Pratt . | |
| 4,437,714 | 3/1984 | Struck | 108/25 X |
| 4,450,774 | 5/1984 | Weaver | 108/23 |
| 4,516,529 | 5/1985 | Lotito et al. . | |
| 4,703,720 | 11/1987 | Shipman et al. . | |

FOREIGN PATENT DOCUMENTS

| | | | |
|---|---|---|---|
| 770311 | 9/1934 | France | 108/23 |

*Primary Examiner*—Kenneth J. Dorner

*Assistant Examiner*—José V. Chen

*Attorney, Agent, or Firm*—Louis Weinstein

[57] ABSTRACT

A rolling display table having a surface with a shallow watertight recess for holding a bed of ice. The center of the recess has a transparent window water-tightly fitted therein. An enclosure beneath the window houses lamps for illuminating the window which may support an ice sculpture or the like to illuminate the ice sculpture to the greatest aesthetic advantage. The ice bed is placed on the shallow recess and about the ice sculpture, to serve as a bed for food stuffs which are maintained chilled such a fruit, pastries, desserts, seafood, and the like. The display surface is supported by decorative legs mounted between the display surface and a lower enclosure mounted upon casters to facilitate rolling movement of the display table. At least first and second flexible tubes extend between drain openings in the display surface for drawing water accumulated due to the melting ice away from the display surface and delivering the water to a tank which is totally concealed within the lower enclosure of the display table. The drain tubes are arranged inside the legs and substantially concealed from view. An electrical wire inside on of said legs couples an electric lamp to a plug connector arranged adjacent to the base portion of the table. The fully concealed tank is provided with a drain plug or valve for draining the tank. The concealed tank does not detract from the aesthetic appearance of the display table and provides a highly stabilized structure.

6 Claims, 3 Drawing Sheets

ROLLING DISPLAY TABLE FOR ICE SCULPTURES AND THE LIKE

FIELD OF THE INVENTION

The present invention relates to display tables and more particularly to a rolling display table for displaying ice sculptures, a bed of cracked ice and the like, and which includes illuminating means for displaying the ice sculpture to best advantage and a fully concealed tank for removing water collected from the melted ice from the recessed display surface to a remotely located, fully concealed tank.

BACKGROUND OF THE INVENTION

Display carts are well known for use in displaying food stuffs and the like, for example, in restaurants, banquets and catering activities. It is known to display a variety of food stuffs on aesthetically appealing display carts. In cases where it is desirable to display perishable food stuffs which typically requires some degree of cooling and to do so in an aesthetically appealing manner, it is know to provide shallow trays such as, for example, stainless steel trays which may be filled with cracked ice which serves as a bed for supporting the food stuffs, such as for example, seafood and more specifically shrimp, lobsters, raw fish and the like. One distinctive advantage of such an arrangement is the fact that the ice undergoes significant melting at room temperatures yielding a sloshy combination of melting ice and water which significantly detracts from the aesthetically appealing appearance of the display. In addition, movement of the display table causes the collected water to slosh about and spill over the lip of the tray.

BRIEF DESCRIPTION OF THE INVENTION

The present invention is characterized by comprising a rolling display cart or table which is capable of providing an aesthetically appealing display of food stuffs and the like arranged upon a bed of cracked ice and further having illuminating means designed to display ice sculptures and the like to their maximum aesthetic advantage.

The rolling display table of the present invention is comprised of an upper display housing supported and maintained a spaced distance above a lower display housing by four (4) decorative corner legs which also support a middle shelf. Casters are provided beneath the lower display table housing to facilitate rolling movement of the display table.

The upper display housing comprises a display surface having a shallow watertight recess for receiving and supporting a layer of cracked ice which serves as a bed for food stuffs and especially those types of food stuffs, both raw and prepared, which must normally be kept cool when on display.

The shallow, watertight display recess is provided with a central opening having a transparent window water tightly fitted into the opening in the base of the recess. The top display housing comprises an enclosure which houses and substantially conceals a light fixture, which is preferably adapted to support and provide electrical energy for several low-heat producing incandescent bulbs or fluorescent tubes which emit light through the aforesaid window. An ice sculpture is placed at the center of the recessed display surface and substantially directly upon the aforesaid window so as to be illuminated by the low heat producing incandescent bulbs or fluorescent lamps, which illumination serves to advantageously display the ice sculpture in an aesthetically pleasing manner.

The recessed display surface is provided with a plurality of drain holes preferably adjacent the window for continuously removing water developed due to the melting of the ice before the water has an opportunity to collect upon the water-tight recess. Drain tubes, which are concealed either within or along the interior sides of the decorative legs, couple the drain openings to a watertight tank which is fully concealed within the lower portion of the display so as not to detract from the aesthetically appealing appearance of the display cart. An electrical wire is coupled between the light fixture and an electrical connecting plug arranged along the outer surface of the lower display table portion. The electrical wire is concealed within one of the decorative legs so as not to detract from the aesthetic appearance of the display table while at the same time providing the necessary electrical connection between the light fixture and a suitable source of alternating current.

The light fixture is arranged within a substantially enclosed space, the lower portion of which is covered with a multi-apertured cover member to allow for the escape of any heat collected within the region housing the lamps and the lamp fixture.

The rolling display table is further provided with a shelf supported by the aforementioned decorative legs between the upper and lower housings to provide an additional storage/or display surface for non-perishable items, which could for example, include dinnerware.

The fully concealed tank, is arranged within the lower housing of the display table, which lower housing supports a plurality of casters, serves to improve the stability of the display table by removing the collection tank from the recessed display surface by the maximum possible distance from the recessed display surface to provide a display table of better balanced design and a pleasing aesthetic appearance.

OBJECTS OF THE INVENTION AND BRIEF DESCRIPTION OF THE FIGURES

It is therefore one object of the present invention to provide a novel display table for supporting and displaying a bed of ice and ice sculptures or the like in a shallow watertight recess and further including a fully concealed tank for receiving and storing water developed due to the melting ice at a location remote from the recessed display surface and which is concealed so as not to detract from the aesthetic appearance of the rolling display table.

Still another object of the present invention is to provide a novel rolling display cart for receiving and supporting a bed of ice and ice sculptures and the like and including means for illuminating the ice sculpture to its greatest aesthetic advantage by means of illuminating a transparent window watertightly fitted within an opening in the center of the recessed display surface.

The above as well as other objects of the present invention will become apparent when reading the accompanying description and drawings in which:

FIG. 1 is a perspective view showing a display table designed in accordance with the principles of the present invention.

FIGS. 2 and 3 respectively show side and end views of the display table of FIG. 1.

DETAILED DESCRIPTION OF THE INVENTION

Figure 1:
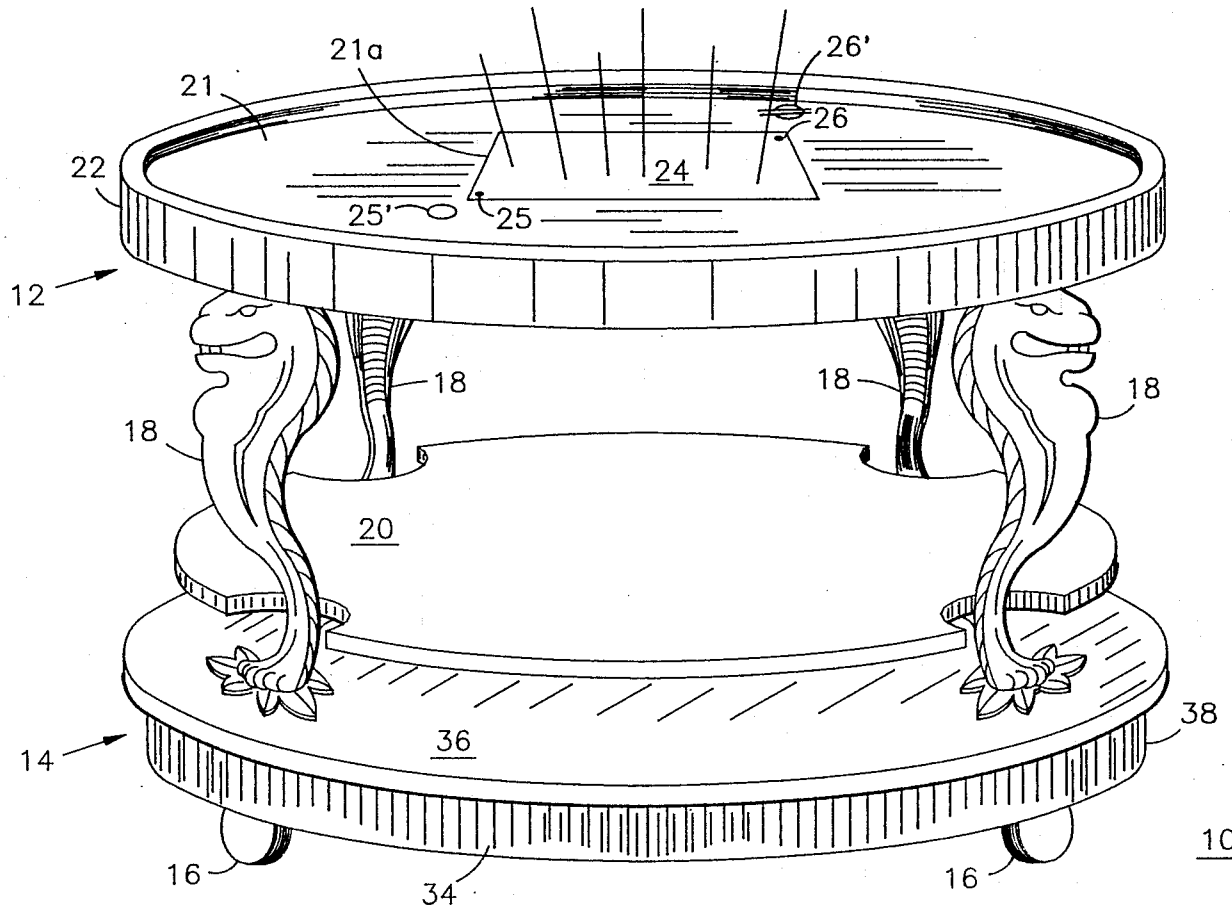
Figure 2:
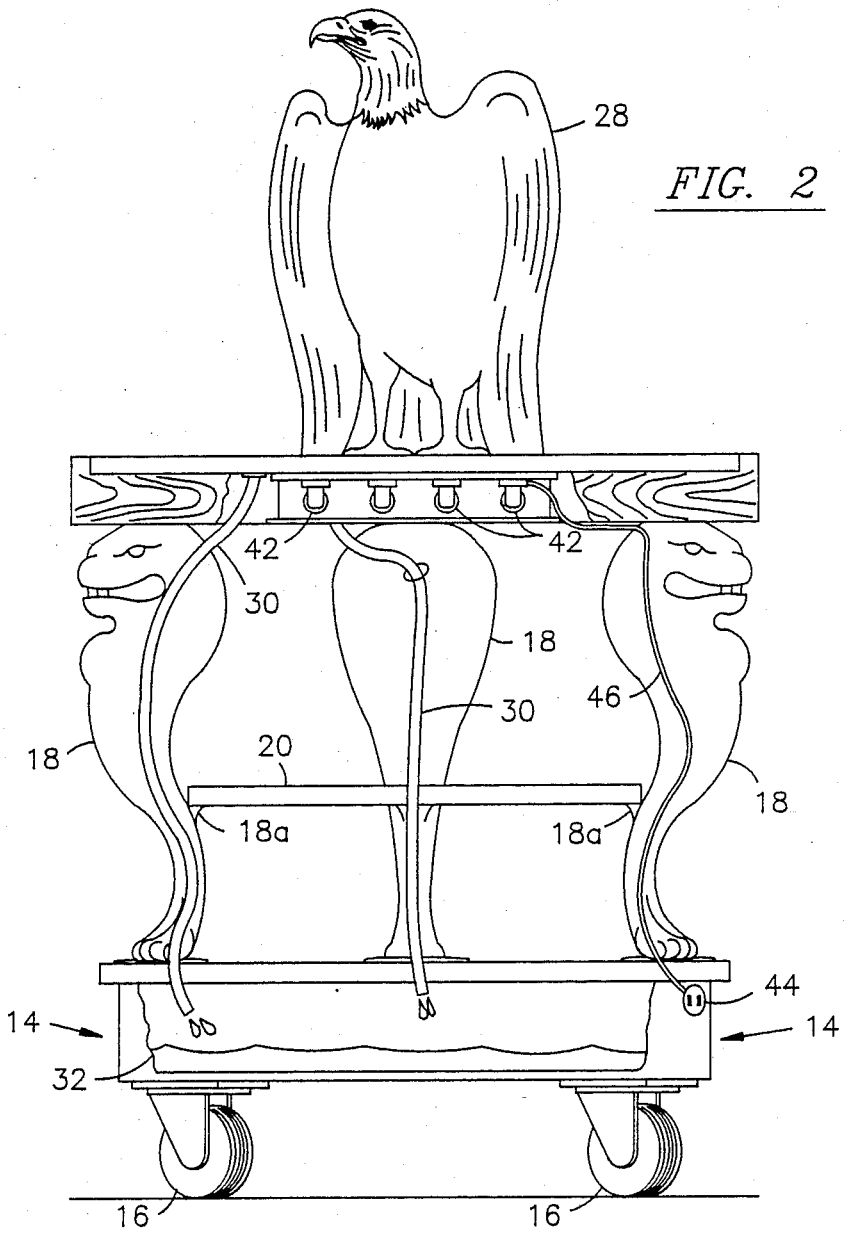
Figure 3:
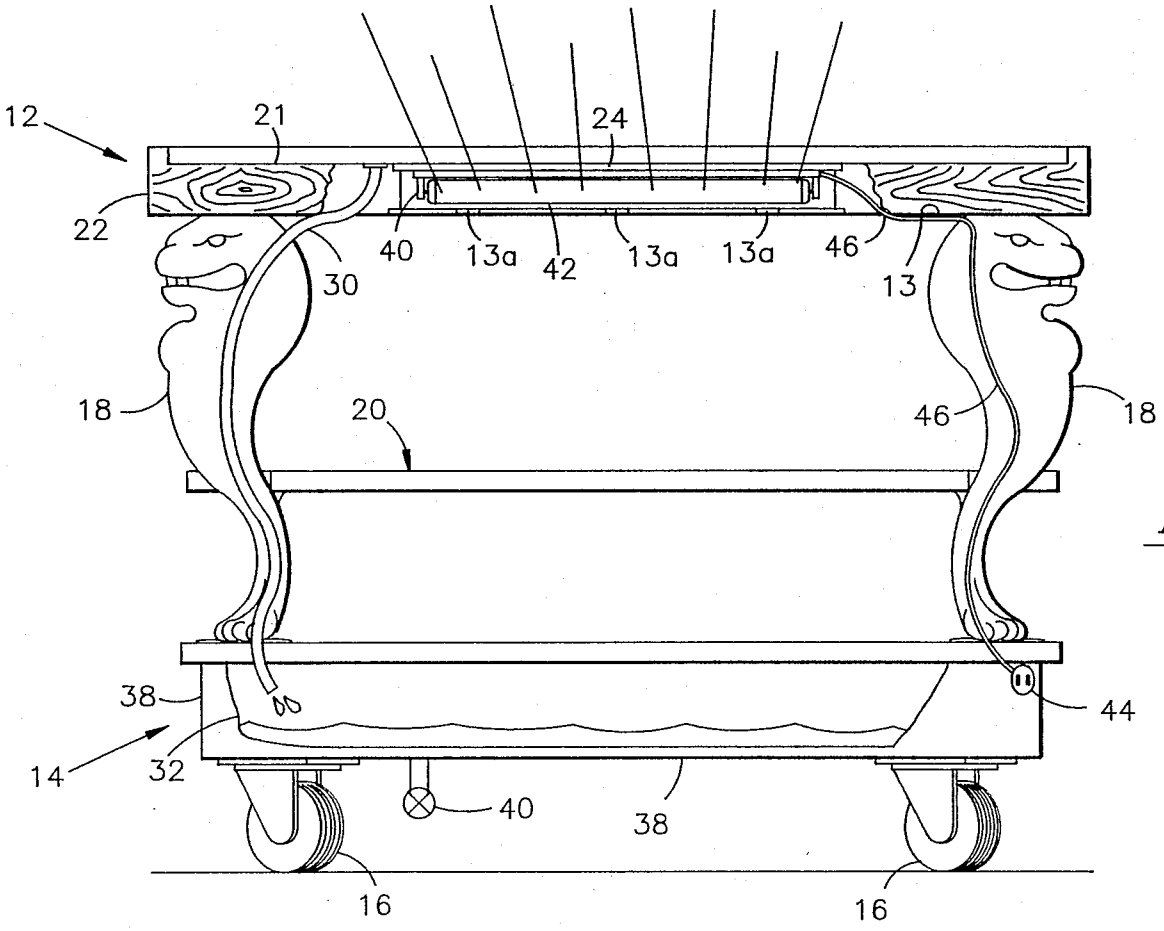

FIGS. 1 through 3 show a rolling display table 10 designed in accordance with the principles of the present invention and comprised of upper and lower housings 12 and 14. Upper housing 12 is supported by a plurality of decorative corner legs 18 which further serve to support a shelf-like display surface 20 at a location intermediate the upper and lower housings 12 and 14. Shelf 20 may be utilized for storing non-perishable items such as non-perishable food stuffs or dinnerware such as plates, cups and saucers, and silverware. Legs 18 are preferably provided with supporting projections 18*a* for receiving and supporting shelf 20.

Top housing 12 is provided with a shallow recessed display surface 21 surrounded by a decorative sidewall 22. Recessed display surface 21 is relatively shallow and is preferably no greater than 3 to 4 inches in depth. The center portion of recessed surface 21 is provided with an opening 21*a* for receiving a transparent window 24 which is watertightly fitted within opening 21*a*. Although opening 21*a* and window 24 are shown as being substantially rectangular, they may be any other desirable shape, such as for example, square, polygonal, circular, oval or the like. Transparent window 24 may be formed of glass or any suitable plastic material. If desired, two or more windows may be provided in recessed surface 21 to display two or more ice sculptures. Openings 25, 26 are provided either in window 24 or alternatively in the floor of recess 21 as shown at 25' and 26' which opening serve as drain holes as will be more fully described hereinbelow. If desired, the surface 21 may slope downwardly toward the drain holes to facilitate removal of the water.

The rolling display table 10 of the present invention is specifically designed for use in displaying food stuffs and especially perishable-type foods which preferably must remain cool when displayed. Such items would typically include fruits, vegetables, desserts, raw meats, raw seafood such as lobster, shrimp, raw fish and the like. In order to display such items in an aesthetically pleasing manner, the recessed display surface 21 is filled with cracked ice. The cracked ice forms a bed for the display of the desired food stuffs. Providing a shallow recess reduces the amount of ice required while providing a layer of sufficient height to enhance the appearance of the bed of ice and to prevent the surface of the recess 21 from showing through.

A decorative ice form or ice sculpture, such as for example, the ice sculpture 28 shown in FIG. 2 which may be molded or carved from a block of ice and in the example shown may, for example, be a decorative eagle. Obviously, any other form of ice sculpture may be employed. Although an ice sculpture is preferred, any transparent or translucent decorative piece may be employed such as a decorative piece formed of translucent or transparent plastic or glass and preferably simulating an ice sculpture.

The ice sculpture 28 is preferably positioned immediately above window 24. The remainder of the recessed display surface 21 is filled with cracked ice which is build-up about the base of ice sculpture 28. The food to be displayed is then placed upon the bed of cracked ice which yields an aesthetically appealing yet highly practical arrangement for displaying raw and/or perishable foods.

A plurality of concealed drain tubes 30 are coupled at their upper ends with the drains 25 and 26 (or 25' and 26') respectively. The drain tubes are either concealed within legs 18 or extend along the interior sides of the legs 18 so as to be effectively concealed from view. The drain tubes 30 extend downwardly through or behind the legs 18 and into suitable openings provided in tank 32. Tank 32 is substantially fully concealed by means of a lower housing comprising a decorative sidewall 34 surrounding tank 32, as well as a decorative top surface 36 which completely covers the top of tank 32 and a floor 38 which further serves as the means for receiving and supporting the bottom ends of the legs or casters 18.

A base 38 encloses the bottom of tank 32 and serves as a means for supporting casters 16 which rollingly support the display table 10 and facilitates the rolling movement and positioning of the display table within a restaurant or banquet hall, for example.

Tank 32 is provided with means 40 which may either be a drain valve or drain plug for draining the contents of tank 32.

FIG. 3 shows a portion of the sidewall 22 broken away in order to expose the lamp fixture 40 which is designed to support and provide electrical energy for a plurality of fluorescent tubes 42. FIG. 3 shows the longitudinal sides of the fluorescent tubes 42 whereas FIG. 2 shows the ends thereof. The fluorescent light fixture 40 is electrically coupled to an electrical connecting plug 44 arranged along sidewall 38 by means of a concealed wire 46 which extends along the underside of a bottom 13 provided in top housing 12 and either extends through one of the decorative legs 18 or is arranged along the interior surface thereof so as to be effectively concealed from view. A suitable extension cord (not shown) may be used to electrically couple plug 44 to a power outlet provided, for example, in the wall of the banquet room. The lamps which may be fluorescent lamps or incandescent bulbs of the low heat producing type provide substantially cool illumination to prevent accelerated heating and melting of the bed of ice and the ice sculpture. The bottom 13 of housing 12 is preferably provided with a plurality of large diameter openings 13*a* to permit any heat which may be developed within the region containing the fluorescent lamp fixture 40 to be carried away.

Since the rolling display table 10 is typically utilized within banquet rooms and the like which are normally at room temperature, melting of both the bed of ice and the ice sculpture is inevitable. However, in order not to detract from the pleasing appearance of the bed of ice and ice sculpture, any water which may develop as a result of the melting ice, is immediately drawn away from the recessed display surface by way of the drain holes 25 and 26 and the drain tubes whereupon the water is collected within tank 32 which, was described hereinabove, is completely concealed within the lower portion of the rolling display table so as not in any to detract from the aesthetic appearance thereof while at the same time, serving as an efficient means for collecting water and preventing the water from detracting from the aesthetically appealing appearance of the ice sculpture and bed of ice arranged upon the recessed display surface. The immediate removal of the water prevents the water from collecting in the recessed surface and sloshing around and spilling when the table is moved. In addition, the collected water may be removed at any convenient time simply by opening the drain valve or removing the drain plug 40.

The arrangement of the tank at the bottom-most portion of the display table (i.e. lower housing 14) significantly lowers the center of gravity thereby greatly enhancing the stability and improving the ease of handling of the display table.

The recessed surface is preferably formed of a suitable water proof plastic material to assure a water-tight recess while simplifying the cleaning of the recessed surface after each use.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed:

1. A display table for displaying perishable food and the like upon a bed of ice comprising:

hollow upper and lower display table housings;

decorative legs mounted upon said lower housing for supporting the upper housing at a spaced distance above said lower housing;

a plurality of casters being mounted to and just below said lower housing for facilitating rolling movement of said display table;

said upper housing having a recessed display surface which recessed surface is relatively shallow and is watertight for receiving a bed of ice therein;

said lower housing containing a watertight tank fully concealed within said lower housing and having receiving openings;

said recessed display surface having a plurality of drain holes;

flexible drain tubes coupled between said drain holes and receiving openings provided in said tank and running along and substantially concealed by an associated one of said legs for providing means for continuously carrying water away from the recessed display surface and formed due to melting of the ice while at the same time not distracting from the aesthetic appearance of the display table and especially the decorative legs thereof;

said shallow recessed display surface being provided with a centrally located opening;

a transparent member being fitted within said opening to provide a substantially watertight fit between said display surface and said transparent member;

said upper housing having a hollow illumination means receiving region; and illumination means being provided beneath said transparent member and within said upper housing illumination means receiving region and being secured to said upper housing and beneath said transparent member for providing light which passes through said transparent member.

2. The display table of claim 1 further comprising a translucent decorative piece arranged upon said transparent member and surrounded by a bed of ice arranged about the base of the decorative piece whereby light from said illumination means passes through said decorative piece.

3. The display table of claim 2 wherein said decorative piece is formed of ice.

4. The display table of claim 1 wherein said illumination means comprising a fluorescent lamp fixture having a plurality of at least one low heat producing bulb fluorescent lamps.

5. The display table of claim 4 further comprising an electrical coupling arranged along an outer surface of one of said upper and lower housings;

an electrical cord extending between said electrical fixture and said electrical coupling and being concealed by said table for providing an electrical coupling for coupling power from an external source to said fluorescent lamp fixture.

6. The display table of claim 5 wherein said electrical coupling is positioned along said lower housing and wherein said cord extends through or behind one of said decorative legs so as to be substantially concealed by said decorative leg while at the same time providing an electrical path between said bulb, low heat producing lamp fixture and said electrical coupling.

* * * * *